United States Patent [19]

Rarden

[11] Patent Number: 4,995,299

[45] Date of Patent: Feb. 26, 1991

[54] TORQUE TRANSMITTING TOOL FOR REMOVING GROMMETS FROM CONCRETE

[76] Inventor: Gary M. Rarden, 9313 13th Pl. SE., Everett, Wash. 98205

[21] Appl. No.: 528,440

[22] Filed: May 25, 1990

[51] Int. Cl.[5] ..... B25B 13/48

[52] U.S. Cl. ..... 81/176.15; 81/488; 29/283

[58] Field of Search ..... 81/176.1, 176.15, 488, 81/176.2; 29/240, 283

[56] References Cited

U.S. PATENT DOCUMENTS 2,659,256 11/1953 Palmer ..... 81/176.15

FOREIGN PATENT DOCUMENTS 1156060 5/1958 France ..... 81/176.15
1176761 4/1959 France ..... 81/176.15
21465 9/1968 Japan ..... 81/176.15

*Primary Examiner*—Roscoe V. Parker
*Attorney, Agent, or Firm*—Russell W. Illich

[57] ABSTRACT

A tool is provided for removing plastic grommets embedded within concrete to be post-tensioned. The tool has a conical shaped head for insertion into the grommet sleeve. The tool includes a wide bore that extends through the entire tool which slips over a central protrusion of the post-tension concrete grommet. The bore is open along its entire length so that the head may be slipped over a cable used to post-tension the concrete. The conical section further includes 2 radially extending slots spaced 90° apart which extend from the bore to the outer periphery of the conical section. These slots transmit the torque to the grommet through wings connected to the sleeve. A hole is provided within the tool for connection of a handle to the tool. The handle manually turns the tool about the axis of the bore, thereby delivering torque to the grommet and releasing it from its embedded position within the concrete. The tool head is uniquely shaped to fit snugly into the grommet and over the protrusion and wings of the sleeve. The conical head allows the tool to be used on grommets of various sizes.

7 Claims, 1 Drawing Sheet

TORQUE TRANSMITTING TOOL FOR REMOVING GROMMETS FROM CONCRETE

BACKGROUND OF THE INVENTION

The present invention relates to a tool for removing plastic grommet sleeves that become imbedded in concrete during the post tensioning process of concrete construction. Presently, these sleeves are removed from the concrete with screwdriver, pliers and other conventional tools. The process can be quite painstaking and time consuming on large construction sites where many of these sleeves must be removed, on e the forms are stripped from the dried concrete. Thus, there has been a need in the field of construction for a tool that makes the removal of these sleeves easier than conventional tools.

SUMMARY OF THE INVENTION

It is an object of this invention to provide a tool that can transmit torque to a sleeve in order to remove the grommet from an embedded position within concrete.

Another object the invention is to provide a tool that can remove a grommet from an embedded position even under conditions where concrete has seeped into or around the grommet, or the grommet has become damaged.

It is a further object of the invention to provide a tool that can be used on conventional grommets in a number of sizes and designs.

Other object of the invention will be apparent hereinafter from the specification and from the recital of the appended claims, particularly when read in conjunction with the accompanying drawings.

The present invention comprises a tool having a head for insertion into a grommet sleeve that is removable from post-tensioned concrete. The head includes a cylindrical portion for mounting a handle in a direction transverse to the axis of the cylinder and a conical section extending along the axis of the cylindrical portion for insertion into a sleeve. The head includes a wide bore that extends through the exes of the cylindrical and conical sections which slips over a central protrusion of the post-tension concrete grommet. The bore is open along its entire length so that the head may be slipped over a cable used to post-tension the concrete. The conical section further includes 2 slots spaced 90° apart and extended from the bore to the outer periphery of the conical section. These slots are key for transmitting the torque to the grommet through wings connected to the sleeve. The tool head is uniquely shaped to fit snugly into the grommet and over the protrusion and wings of the sleeve. The conical head allows the tool to be used on grommets of various sizes.

DETAILED DESCRIPTION OF THE INVENTION

Figure 1:
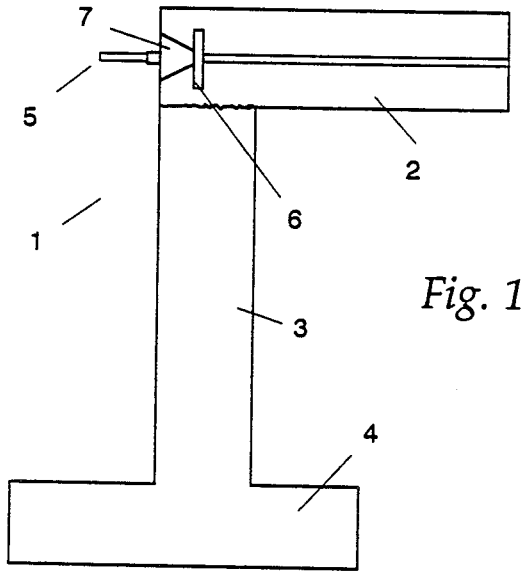
FIG. 1 shows a cross-sectional plan view of a wall using the post-tensioned process with a cutaway section to reveal the grommet and cable.
Figure 2:
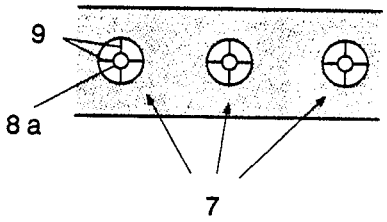
FIG. 2 shows a front plan view of a concrete beam with the post-tension grommets embedded in the concrete.
Figure 3:
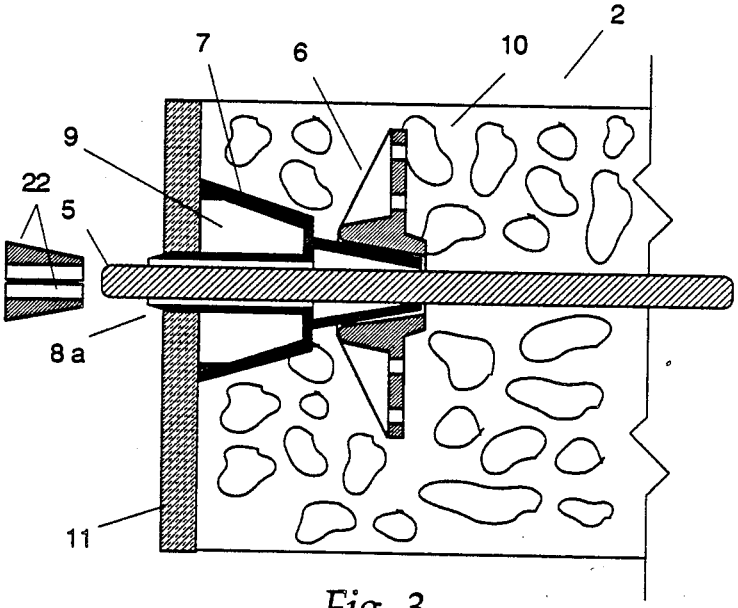
FIG. 3 shows a detailed cross-sectional view of the concrete beam of FIG. 1.

FIGS. 1–3 show a concrete construction 1 using the post-tensioning prcess. A beam 2 to be post-tensioned is supported by a wall 3 which in turn is supported by a footing 4. A cable 5 extends though the beam which delivers the post tensioning pressure to the beam upon removal of the forms 11 from the beam. If a wide slab is intended to be post-tensioned, as shown in FIG. 2, or an entire floor is to be post-tensioned, a plurality of cables will extend parallel to one another across the entire width of the slab or floor. A grommet/sleeve is inserted into an embedment plate 6. The cable is then inserted through the plate and sleeve assembly and the plate is secured to the form by nails or some other fastener (not shown). In this position, the cable 5 is suspended within the form by the plate and sleeve assemblies at either end of the form.

Wet concrete is poured all around the plate 6, grommet 7, and cable 5 as best seen in FIG. 3. Once the concrete has dried and cured to an adequate amount of time, the forms 11 are stripped from the dried concrete 10. FIG. 2 show a side view of a concrete slab with the forms stripped and the grommets 7 still imbedded in the concrete. At this time, the grommets must be removed to proceed with the post-tensioning process. Once the grommets are removed, lock wedges 22 are inserted into the embedment plate where the grommet previously resided. A hydraulic cable tensioning device, or ram, is then attached to the cable 5 and the cable is tensioned to the proper degree.

Figure 7:
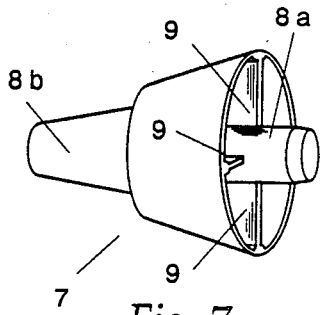
FIG. 7 shows a perspective view of the grommet shown in FIGS. 1–3.

FIG. 7 shows a detailed view of the grommet 7 which includes an internal protrusion 8*a* extending out of the sleeve and away from the concrete. The grommet also includes an external protrusion 8*a* which extends into the embedment plate 6 and concrete 10. Both protrusions include a central bore therethrough to support the cable 5. Transverse wings or flanges 9 are arranged about the protrusion 8*a* at 90°, 180°, 270° , and 360° on the sleeve.

Figure 4:
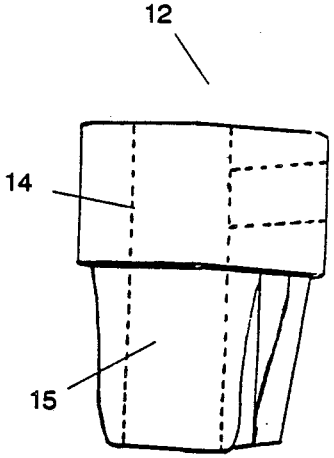
FIG. 4 shows a side plan view of the tool head used in the present invention.
Figure 5:
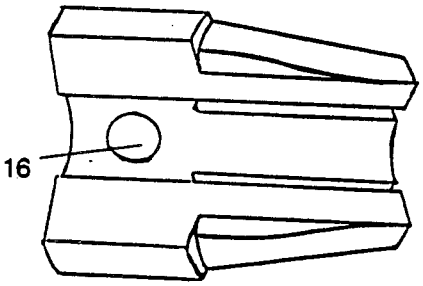
FIG. 5 shows a side plan view opposite the side view of FIG. 4.
Figure 6:
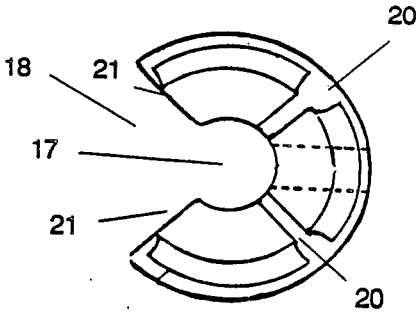
FIG. 6 shows a front plan view of the tool head of FIG. 4.

The present invention deals with the removal of the grommets once the forms are stripped from the dried concrete. As shown in FIG. 2, there can be many of these embedded grommets 7 on a construction site. It is common practice, today, for a worker to use pliers and/or screwdrivers to pry the sleeve 7 from the concrete. This removal procedure can be quite painstaking when concrete has seeped into the sleeve or when the sleeve has become damaged during pouring of the concrete. On smaller construction sites such as residential housing, there may not be many post-tension grommets to remove from the concrete, but on commercial construction sites there are sometimes hundreds or even thousands of these sleeves to remove. Thus, a tool to make the removal of the grommets easier would be a considerable time-saving tool. Furthermore, on high rise construction sites where a worker is removing the grommets at a considerable height above the ground, the use of such as tool would have safety implications, as well. FIGS. 4–6 show plan views of a tool for removing the grommets 7 from embedded concrete. The tool includes a head 12 having a cylindrical portion 14 connected to a conical portion 15. The cylindrical portion includes a tranverse bore 16 for insertion of a handle. The bore 16 may be smooth sided (as shown), for forced-handles, or have internal threads for an externally threaded handle.

The head 12 futher includes a wide axial bore 17 that extends through the entire length of the head, as best seen in hidden lines in FIG. 4. The bore 17 is dimensioned so that it may slip over the internal protrusion 8*a* of the grommet 7. The axial bore 17 includes an open end or noted 18 so that the had may be slipped over the post-tension cable 5 adjacent to the grommet.

The conical portion of the head further includes bearing surfaces to place torque upon the four wings 9 of the grommet. The first two bearing surfaces are shown as radial slots 20 that extend from the bore 17 or the outer periphery of the conical portion 15. The other two bearing surfaces are the outer walls 21 of the open notch 18. The outer walls 21 and radial slots 20 are arranged 90° apart around the periphery of the conical portion, as best viewed in FIG. 6.

Operation of the tool for removing the grommets from the concrete is hereby explained. The open notch 18 of the tool 12 is slipped over the cable 5 adjacent the dried concrete 10. The notch 18 is important because the free ends of the cables often extend quite far from the grommets, so the notch saves time by not requiring the worker to find the free end of the cable. Once, the tool is fitted around the cable, the tool is slid along the cable until the conical section 15 of the tool enters thhe grommet 7. The slots 20 are aligned with the wings 9 of the grommets and the tool is pushed all of the way into the sleeve until it reaches the end of the grommet. At this time, the worker exerts a hard torque motion to the handle of the tool which will subsequently wrench the embedded grommet free from the concrete 10. The tool is then removed from the grommet and cable, and the grommet is pulled out from the concrete and pushed down along the length of the cable. Once the grommet is removed, the lock wedges may be inserted into the embedded plate and the ram can be attached to the cable to post-tension the concrete.

The tool is very easy to use and can deliver a high amount of torque to the grommet in adverse conditions. For example if concrete has seeped into the sleeve and blocks part of the path of the tool, the worker need not insert the tool all the way into the grommet to still deliver a substantial amount of torque to the grommet. This relieves the need for the worker to chip concrete from the grmmet before removal.

It should be apparent that many modifications could be made to the torque transmitting tool which would still be encompassed within the spirit of the present invention. It is intended that all such modifications may fall within the scope of the appended claims.

What is claimed is:

1. A tool for transmitting torque in combination with a grommet embedded in concrete and a portion of a cable extending outwardly from said grommet for post tensioning the concrete, said grommet having an open cavity and at least one wing extending transverse across the entire length of said cavity, said tool comprising:

a head portion for insertion into said cavity of said grommet, said head portion comprising a body, said body having an outer peripheral surface and a longitudinal bore therethrough, said body further comprising an open notch extending radially from said bore to said peripheral surface for allowing said body to be placed around said cable and inserted into said cavity of said grommet, a means for transmitting torque to said grommet extending outwardly from said head portion, said torque transmitting means of a length to transmit torque across the entire length of said wing of said grommet to dislodge said grommet from an embedded position;

a handle for rotating said head portion.

2. A tool for removing a grommet embedded in concrete, comprising:

a head portion for insertion into a cavity of the grommet;

a means to transmit torque to said head portion;

a means to transfer torque from said head portion to said grommet;

a means to prevent a cable extending from the grommet from interfering with the delivering of torque to the grommet;

said head portion is of a conical shape to match a conical shape of the cavity of the grommet;

3. A torque transmitting tool as claimed in claim 2, wherein, said means for preventing the cable from interfering with the torquing process comprises an axial bore through said tool, said bore of a larger diameter than the cable and surrounds the cable when said head is inserted into the cavity of the grommet.

4. A torque transmitting tool as claimed in claim 3, wherein, said means for transfering torque from said head portion to the grommet comprises at least one slot extending radially from said axial bore to the outer peripheral surface of said head portion, said slot coacting with a wing extending within the cavity of the grommet.

5. A torque transmitting tool as claimed in claim 3, wherein, said means to transmit torque to said head portion comprises a handle extending transverse to said axial bore, said handle capable of transmitting torque when manually turned about the axis of said bore.

6. A torque transmitting tool as claimed in claim 3, wherein, said means to prevent the cable from interfering with the torquing process further comprises an open notch within said axial bore extending outwardly to the periphery of said tool, said notch of a width smaller than the diameter of the cable so that the tool may be slipped over an intermediate portion of the cable.

7. A torque transmitting tool as claimed in claim 6, wherein, said notch comprises two surfaces on said head portion, said two surfaces act as said means for transferring torque from said head portion to the grommet, said surfaces coacting with a plurality of wings within the cavity of the grommet.

* * * * *